US007595451B2

(12) United States Patent
Kircanski et al.

(10) Patent No.: US 7,595,451 B2
(45) Date of Patent: Sep. 29, 2009

(54) WIRE MESH SEAL ELEMENT WITH SOFT, FLAT, HARD, AND ROUND WIRES

(75) Inventors: Zlatomir Kircanski, Cumberland, RI (US); Sivanandi Rajadurai, Cumberland, RI (US)

(73) Assignee: ACS Industries, Inc., Lincoln, RI (US)

( * ) Notice: Subject to any disclaimer, the term of this patent is extended or adjusted under 35 U.S.C. 154(b) by 0 days.

(21) Appl. No.: 11/375,424

(22) Filed: Mar. 14, 2006

(65) Prior Publication Data

US 2006/0144614 A1 Jul. 6, 2006

Related U.S. Application Data

(63) Continuation-in-part of application No. 10/616,768, filed on Jul. 10, 2003, now Pat. No. 7,012,195.

(51) Int. Cl.
*H01B 7/08* (2006.01)

(52) U.S. Cl. ..... 174/117 M

(58) Field of Classification Search ..... 174/117 M; 55/525; 277/647, 650

See application file for complete search history.

(56) References Cited

U.S. PATENT DOCUMENTS

| | | | | |
|---|---|---|---|---|
| 2,334,263 | A * | 11/1943 | Hartwell | 210/494.2 |
| 2,438,146 | A | 3/1948 | Candee et al. | |
| 3,316,345 | A * | 4/1967 | Toms et al. | 174/126.1 |
| 4,278,717 | A | 7/1981 | Aoyama | |
| 4,345,624 | A | 8/1982 | Rider | |
| 4,607,851 | A | 8/1986 | Usher | |
| 4,817,613 | A | 4/1989 | Jaraczewski et al. | |
| 5,091,609 | A | 2/1992 | Sawada et al. | |
| 5,569,220 | A | 10/1996 | Webster, Jr. | |
| 5,617,900 | A | 4/1997 | Weil | |
| 6,286,840 | B1 * | 9/2001 | Zettel | 277/647 |
| 2005/0006134 | A1 | 1/2005 | Zettel et al. | |
| 2006/0096262 | A1 * | 5/2006 | Andersen et al. | 55/523 |

FOREIGN PATENT DOCUMENTS

| | | | |
|---|---|---|---|
| JP | 51-36912 | | 3/1976 |
| JP | 07024903 | * | 1/1995 |

OTHER PUBLICATIONS

Rajadurai, et al., "Edge-Seal Mouting Support for Diesel Particulate Filters," Society of Automotive Engineers, Document 2005-01-3510, Nov. 2005.

* cited by examiner

*Primary Examiner*—Chau N Nguyen
(74) *Attorney, Agent, or Firm*—Maurice M. Klee

(57) ABSTRACT

A compressed knitted wire mesh article having soft and hard wires, some of which are flat and some of which are round, is used a bushing, seal, seat, bushing, or catalyst support, and is especially useful as an end seal for a catalytic converter. The soft wire can be flat and disposed on the outside to aid it shielding the internal wire from corrosion due to impingement of hot exhaust gasses, and provides increased surface area for better sealing around the catalytic monolith. The hard and soft wires can be co-knit in the same knitting head as alternating wires or in any order, or with one wire wrapped around the other being fed to the knitting needle, or as a striped pattern. The mesh can be textured by precompression, such as crimping between rolls.

20 Claims, 6 Drawing Sheets

WIRE MESH SEAL ELEMENT WITH SOFT, FLAT, HARD, AND ROUND WIRES

RELATED APPLICATIONS

This application is a continuation-in-part of application Ser. No. 10/616,768, filed Jul. 10, 2003, now U.S. Pat. No. 7,012,195, the disclosure of which is incorporated herein by reference.

BACKGROUND OF THE INVENTION

1. Field of the Invention

This invention relates to wire mesh support elements especially for high temperature environments, and methods for making the same.

2. The State of the Art

Devices made from knitted wire mesh are commonly used as seals, bushings, seats, and supports in exhaust systems for internal combustion engines. Such devices are used in connecting exhaust system conduits, supporting the periphery of the catalytic converter in its housing, and supporting the axial ends of the catalytic converter in its housing, among other functions.

In these types of devices, a wire is knitted into a desired mesh, and the mesh is compacted in a die into a desired geometry. The compaction is usually partial so that a structure having some porosity is produced, and the partially-compacted porous structure can be infiltrated with a high temperature resistant material, such as described in U.S. Pat. No. 5,385,873 (the disclosure of which is incorporated herein by reference). Other times the compaction results in a denser article that can be used as a bushing at the end of a catalytic converter, such as described in U.S. Pat. Nos. 4,683,010 and 6,286,840 (the disclosures of which are incorporated herein by reference). Still other devices are even more densely compacted and can be used as a filter element in an air bag and/or an exhaust assembly, as described in U.S. Pat. No. 6,277,166 (the disclosure of which is incorporated herein by reference).

In the area of bushings, seals, and supports used in combination with catalytic converters, there are two basic uses for such devices, whether or not made of wire mesh.

One type of support device spans the perimeter of the catalytic converter substrate or support, which is usually round or oval in shape, and this device supports the substrate in its metal housing, giving the housing its characteristic round or oval shape when seen from the underside of the car, although the substrate and its housing can be in any geometry. A conventional substrate is a ceramic monolith. In this environment, the device must cushion the monolith from bumps and jolts in a radial direction (with respect to the direction of the gas flow through the ceramic monolith) and provide protection from exhaust gases leaking around the monolith.

The other type of support device is used at the ends of the substrate, where the exhaust gases enter the pores of the monolith for catalytic conversion, and where the catalytic reaction products exit. In this environment, the support device must cushion the monolith from bumps and jolts in the axial direction (again with respect to the direction of the gas flow) and should direct the hot inflowing gas stream away from the perimeter of the monolith to avoid damaging the perimeter support device and bypassing the conversion process. These end location support devices can be thought of as also providing a sealing or baffling function because they deflect the hot exhaust gases from impinging on the perimeter support device and seal the gas conduit so the exhaust gases enter the catalytic converter as intended. The perimeter cushioning device may be an intumescent mat. The hot exhaust gas can erode the edge of the mat, thereby compromising its cushioning ability and eventually causing the mat to fail. Some prior art end-located support devices were comprised of a compacted element with round wire on the outside and flat wire on the inside.

Problems with wire mesh support devices used in exhaust systems are typically thermal expansion effects and corrosion effects, especially in the environment of the catalytic converter. The cold working (drawing, molding) of wire can cause hardening of the wire, which thereby affects the compression characteristics of the wire mesh element. The thermal expansion of hardened wire that does not soften upon heating can crack the ceramic monolith. On the other hand, wire that softens upon heat requires accounting for different compression characteristics at different temperatures. Yet other problems involve corrosion: wire that maintains its compression characteristics is typically not as corrosion resistant as wire that softens upon heat, which is typically more corrosion resistant.

SUMMARY OF THE INVENTION

In light of the foregoing, this invention provides a wire mesh element especially for use in the exhaust system of an internal combustion engine, but generally suitable for providing mechanical support and some sealing benefits in any hot and/or corrosive gas environment.

One object of this invention is to provide such an element having improved compression characteristics.

Another object of this invention is to provide such an element while avoiding the problems of thermal expansion that can crack the catalyst support.

Yet another object of this invention is to provide such an element that cushions against axial and/or radial movement, and preferably having tailored axial and radial compression characteristics.

Still another object of this invention is to provide such an element that will not deteriorate or lose its ability to protect the substrate (e.g., the monolith) after being subjected to the high temperature environment, and through the cooling cycles between ambient and the high temperature environments that occur with daily use of the engine.

Yet another object of this invention is to provide such an element with improved properties for preventing the hot gas from flowing through the element.

In summary, this invention provides a wire mesh element having a combination of hard and soft wire meshes, and the outer surface having the softer wire. In a preferred embodiment, the soft wire is flat and the hard wire is round.

This invention also provides a method for making such an element by overknitting a hard wire mesh tube onto a soft wire mesh tube, inverting and rolling the tube-within-a-tube structure into a ring, and then compressing the ring into the desired shape. In a preferred embodiment, by predetermining the density of each of the two mesh tubes, and by rolling up from both ends of the interdisposed tube structure, different portions of the element can be made with different compression characteristics.

The wire mesh elements of this invention: does not interfere with present assembly procedures when used as the end element for a catalytic converter; has a compression characteristic that will not damage the ceramic monolith; maintains its compression characteristics after heating and cooling cycles; meets all present engineering requirements for durability; prevents hot exhaust gases from contacting the perimeter support; and provides axial and radial mechanical cushioning.

DETAILED DESCRIPTION OF SPECIFIC EMBODIMENTS

Wire knitting machines are well-known to those in the art. Among those machines are ones that knit a tube (or sock), and those types of machines are used in making the elements of this invention.

In general, when wire is made, it has undergone a number of size reductions at a reduced temperature (i.e., much below its annealing temperature). This "cold working" makes the wire harder, but less ductile. The ductility can be increased by heating or annealing the wire, and the annealing also reduces the hardness of the wire, or "softens" it (so the properties after annealing are more akin to the metal prior to cold working). In prior art articles, because of the aforementioned problem with cracking the ceramic monolith, soft (annealed) wire is used.

In the present invention, a combination of hard and soft wire is used. In addition, it is preferred that the soft wire be flat and the hard wire be round.

The soft wire is comprised of any high temperature resistant metal, preferably stainless steel, such as type 309, preferably type 310 or higher, that can be knit. For a diesel and other low temperature applications (for example, less than about 10000° F., about 540° C.), including mechanical bushings, type 304 stainless steel wire is suitable. In general, any ferritic, and preferably austenitic, wire is suitable. Preferably the wire is also flattened and so has a greater surface area, acting as a baffle in the element to prevent the exhaust gases from passing through the element; at the end of a catalytic converter, this baffling effect directs the gases into the converter. Various wire diameters can be chosen, depending on the desired compression characteristics and the baffling effect needed. In general, the soft wire diameter (prior to flattening) is about 0.1 mm to about 0.3 mm. When flattened, the wire is preferably flattened to a thickness of about one-third of the diameter. A suitable wire for a gasoline engine is 310 wire having an initial diameter of about 0.15 mm and flattened to a thickness of about 0.05 mm. If the mesh is knitted on a multifeed machine, the thickness of the wire on each spool need not be identical; it is sufficient that all of the wire thickness meet the intended specification.

The wire, after flattening if flattened, is knitted into a mesh having a tube configuration in a conventional wire knitting machine.

Optionally thereafter, the wire mesh is annealed in an oxide-producing atmosphere. For example, a mesh made from 310 type wire can be annealed at 1000° C. in an oxygen-containing atmosphere for about five minutes. This annealing step softens the wire, provides an oxide coating on its surface (which enhances its resistance to corrosion), and stabilizes the compression characteristics (both axial and radial) of that mesh element.

Figure 1:
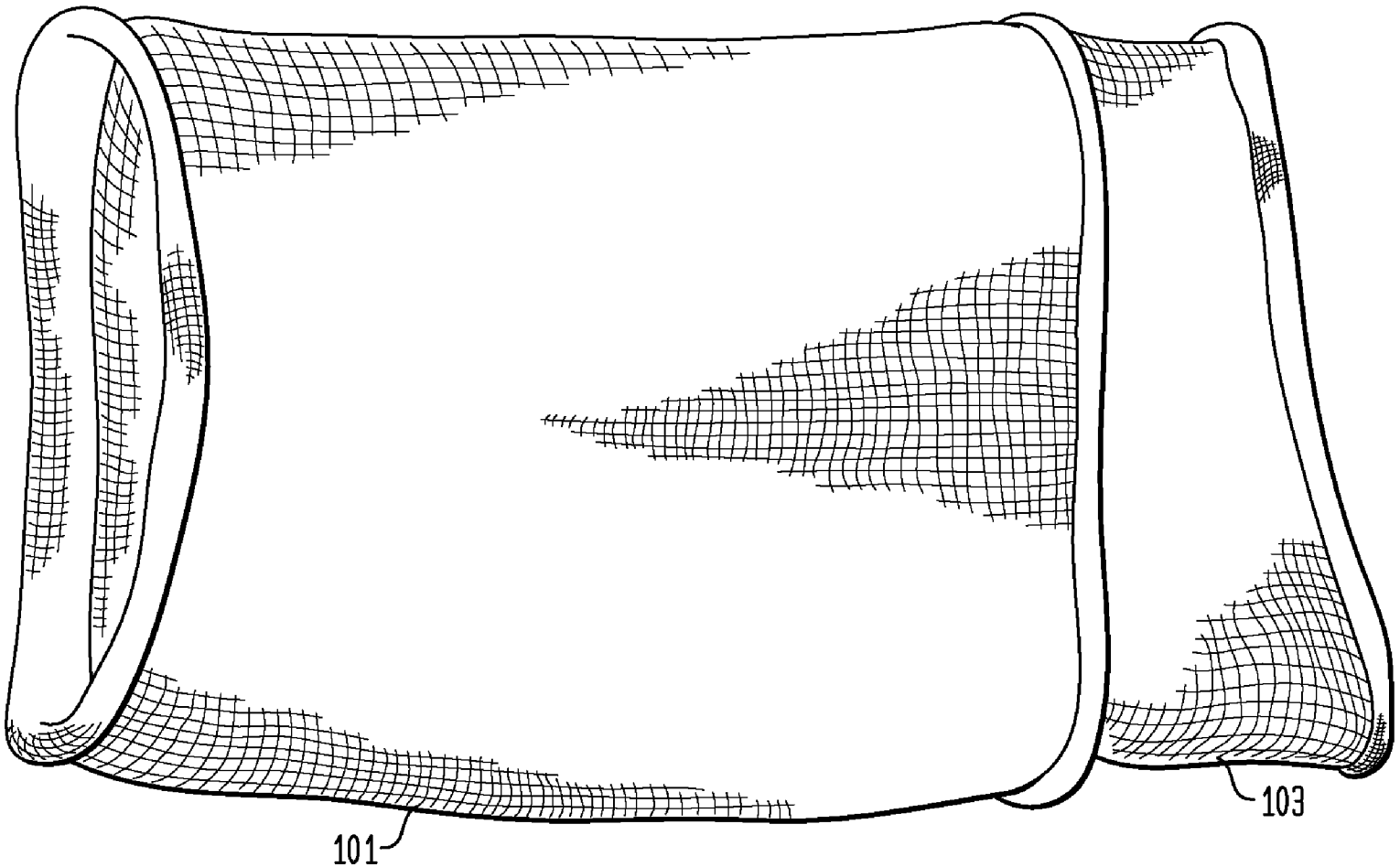
FIG. 1 depicts a knitted flat wire mesh tube disposed partially within a knitted round wire mesh tube.

The soft wire mesh is then fed into the mouth of a conventional wire knitting machine and a round wire mesh tube is overknit onto the soft wire mesh tube. The round wire is preferably a precipitate-hardened stainless steel, such as type A286 or higher. This precipitation-hardened wire also hardens at high temperatures, so the springiness of the mesh increases as the temperature increases to the operating temperature the first time; that is, the spring force of the mesh increases with temperature. Once this precipitation-hardened mesh is hardened the first time in operation, it maintains that hardness. In manufacture, it is preferred that the ends of the two tubes be attached (such as by clamping or crimping) and taken up together as the hard wire mesh is knitted over the soft wire to provide interdisposed mesh tubes. As seen in FIG. 1, a hard round wire mesh tube 101 is overknit onto the soft flat wire mesh tube 103.

The temper (tensile strength) and/or surface texture of the mesh can be altered if desired, and either the soft wire mesh prior to overknitting, or the overknit mesh, or both can be worked. Tempering can be achieved by heating or mechanically. A preferred method is mechanically rolling the overknit mesh between patterned rolls, such as to form a herringbone or checkered pattern, effectively providing a crimped mesh. The crimping can provide a surface texture to the mesh of various, and/or varying, heights and widths, and orientations. The mesh can be run through multiple crimping operations. The mesh can also be coated with a flux and/or brazing composition so the compressed article (described below) can be heat treated to braze, solder, or otherwise connect wires that are touching.

Figure 2:
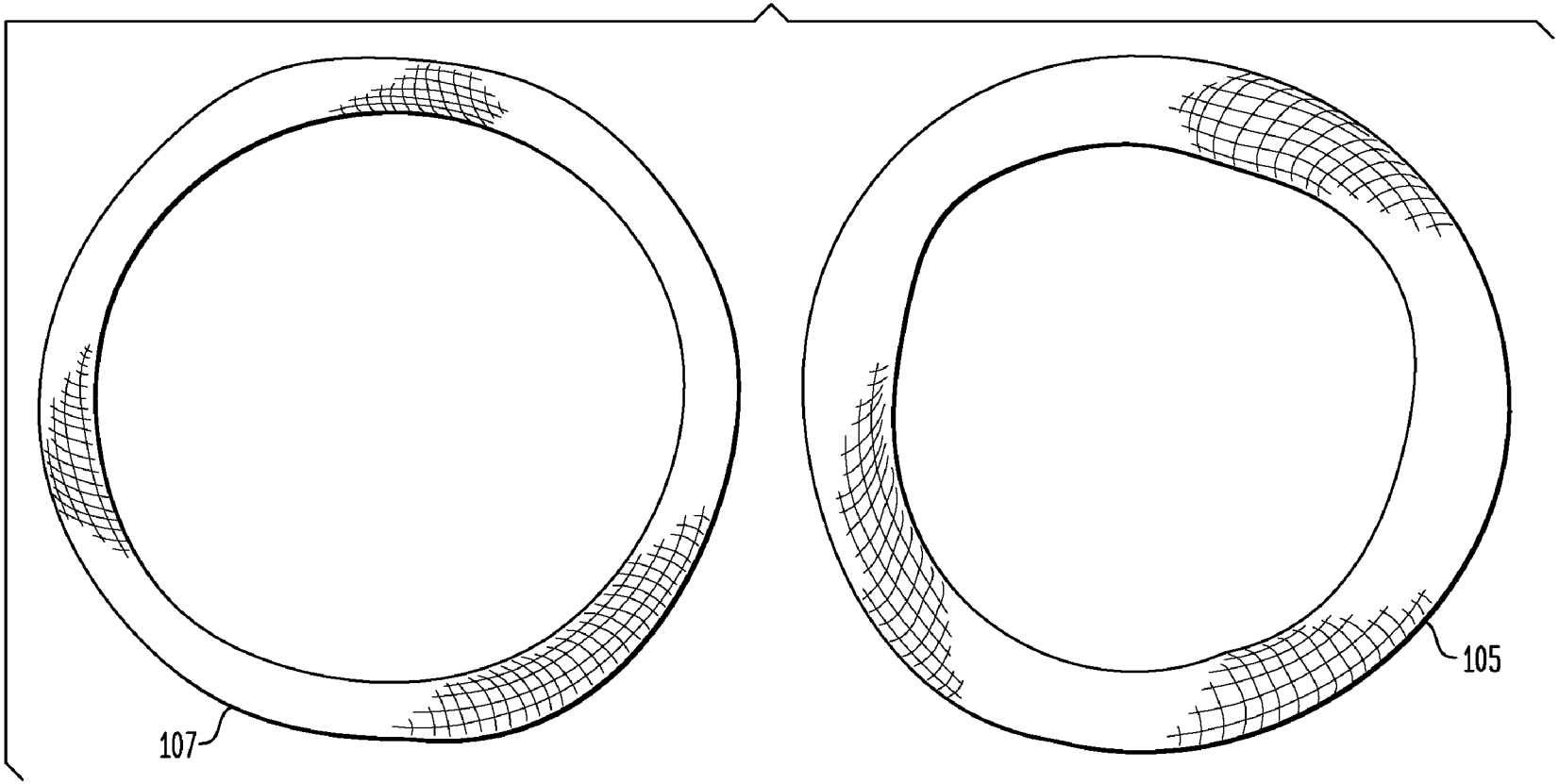
FIG. 2 depicts the interdisposed tubes of FIG. 1 as rolled up, and as partially flattened.
Figure 3:
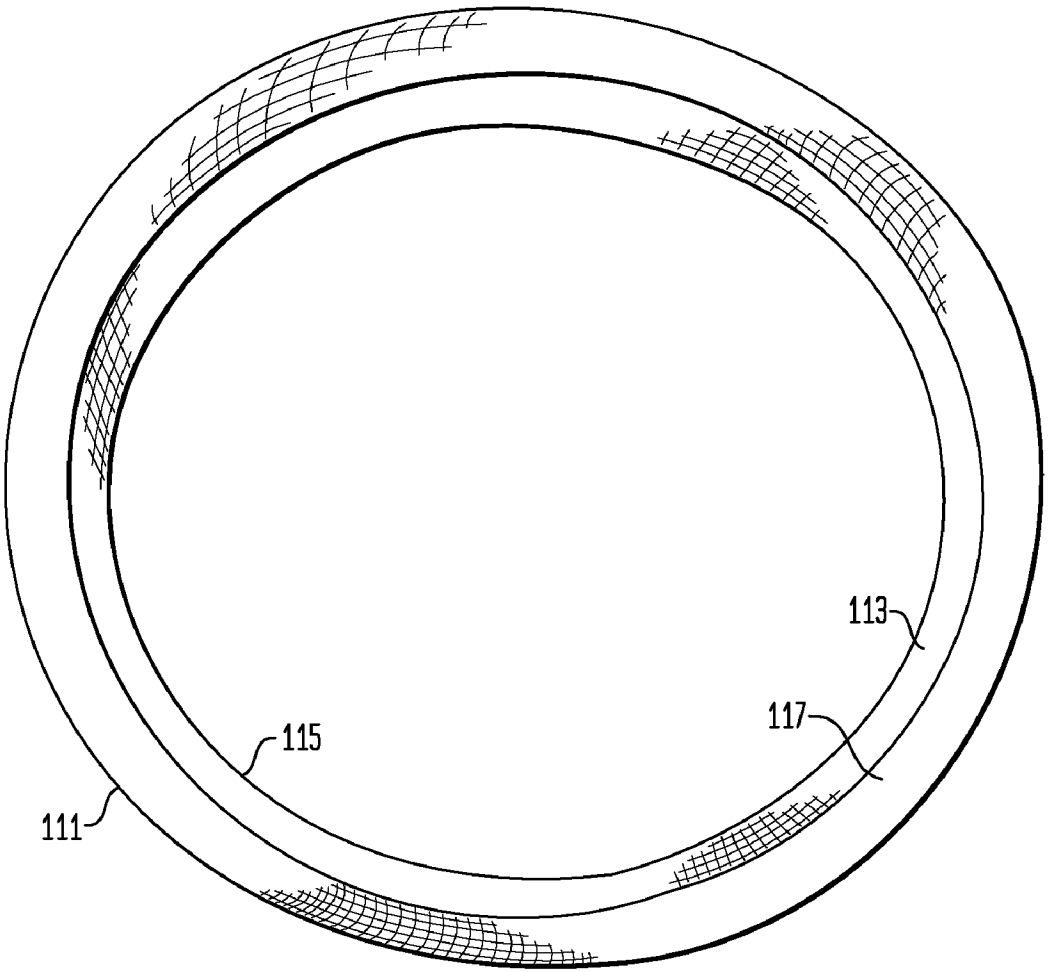
FIG. 3 depicts the flattened article seen in FIG. 2 after shaping in a die.

After the interdisposed (dual) mesh tubes are taken up, a support device is made as follows. The dual mesh tube is cut to a predetermined weight. The weight is determined after prototype parts of the desired dimensions are made to a desired density, the weight of the part is then determined, and the corresponding length of the dual mesh tube is cut after the weight per length of the dual mesh tube is determined. The dual mesh tube is then rolled up to produce a ring 105 as seen in FIG. 2. When the dual tube is rolled up, essentially turned inside out, the inner soft wire mesh ends up on the outside of the ring. In addition, the amount (weight) of mesh needed for a typical support element requires multiple turns when rolling up, resulting in a multilayer ring. This ring is then flattened to produce a flattened ring 107 as seen in FIG. 2. The flattening is not necessary, but can facilitate placing the ring into a die for molding into the final shape desired. The flattened ring is molded to produce a seal element 111 as seen in FIG. 3, wherein the seal element has a ring wall portion 113 and a flange or lip 115 at one edge of the wall that extends into the central bore 117. The lip provides axial cushioning, and the ring wall provides radial cushioning. Molding is typically performed by using an open female die, placing the flattened ring into the female die, inserting a male tamp into the die, and compressing. Of course, the element can be molded into any desired geometry, such as an elliptical shape (oval or round) or a rectilinear shape (square, rectangular, or any regular or irregular polygon, for example), or a combination (for example, semi-circular, pie wedge-shaped). The die can provide for the element to have little protrusions, as described in the aforementioned U.S. Pat. No. 6,286,840 patent, so that the elements are less likely to stick together when made to stack or nest together. The element for a catalytic converter as described herein is not meant to stack or nest.

In operation, the final seal element includes a combination of soft and hard wires. As a bushing, seating, and/or sealing element in a catalytic converter, the element is exposed to increasing temperature as the catalytic converter comes up to operating temperature. The spring force of the hard wire increases with this increasing temperature, and the wire tends to expand due to thermal expansion. The hard wire mesh is surrounded by the soft wire mesh and tries to expand into it, making the element more rigid (like inflating a tire) and thereby providing better mechanical support properties in this environment. Accordingly, a precipitate work-hardening austenitic material is preferred for the hard wire because it will have improved hardness at higher temperature rather than softening at higher temperatures. The soft wire also expands at the operating temperature, which accommodates the space created by thermal expansion of the metal catalytic converter housing. The configuration with the hard wire inside the soft wire provides a structure where the thermally-induced expansion of the hard wire is checked by the outside soft wire, the expansion of the hard wire making the element more rigid, and the expansion of the soft wire acting to fill space caused by thermal expansion of the containing structure. In addition, the mesh loops mechanically interlock during compression, essentially fixing the size of the element. Accordingly, as the wires element attempt to expand at the higher operating temperatures, the element becomes more rigid, providing better sealing and compression properties, yet does not cause undesired forces on the ceramic monolith. The soft wire on the outside of the element helps to cushion the ceramic substrate from the hard wire inside the element as the hard wire expands. In addition, the type 310 soft wire has better corrosion resistance than the A286 precipitation-hardened wire, and being on the outside of the element helps to protect the internal hard wire from corrosion due to impingement of the exhaust gases.

When the engine is turned off, the compression characteristics stay the same, so that when the engine is restarted after having cooled off, the substrate experiences the same compression characteristics. In this way, by determining the compression characteristics desired for a particular application, there is almost no need to engineer or accommodate changes to those characteristics due to the heating and cooling cycles from starting and stopping the engine. Another part of these improved characteristics is due to the use of the flat wire on the outside of the element to increase the resistance to gas flow through the element, whereby gases are diverted to the interior bore (117) of the element. The flat wire fills more space per unit weight than the round wire, and being on the outside provides a surface more akin to a solid surface than round wire, but being soft does not provide undue pressure on the ceramic substrate. Accordingly, the flat wire acts to prevent or reduce impingement of the hot gases onto the hard wire, and so should be made of a corrosion resistant metal. Therefore, it is preferred that the element be positioned on the upstream side of the catalytic converter. It may also be used on the downstream side, or another type of support element can be used on the downstream side.

The substrate (support) for the catalyst need not be ceramic monolith; it may be made of any material that is suitable for supporting the catalyst, by whatever means, and has suitable strength, toughness, non-reactivity, and corrosion characteristics to function in the environment of the catalytic converter. Whatever the composition of the support, the outside wire of the element is preferably flat in order to provide a larger surface area in contact with the monolith. By increasing the surface area of contact the frictional force between the element and the monolith is increased, thereby helping to keep the element and the monolith in contact with each other (the element grabs onto the monolith better when flat wire is present).

Figure 4:
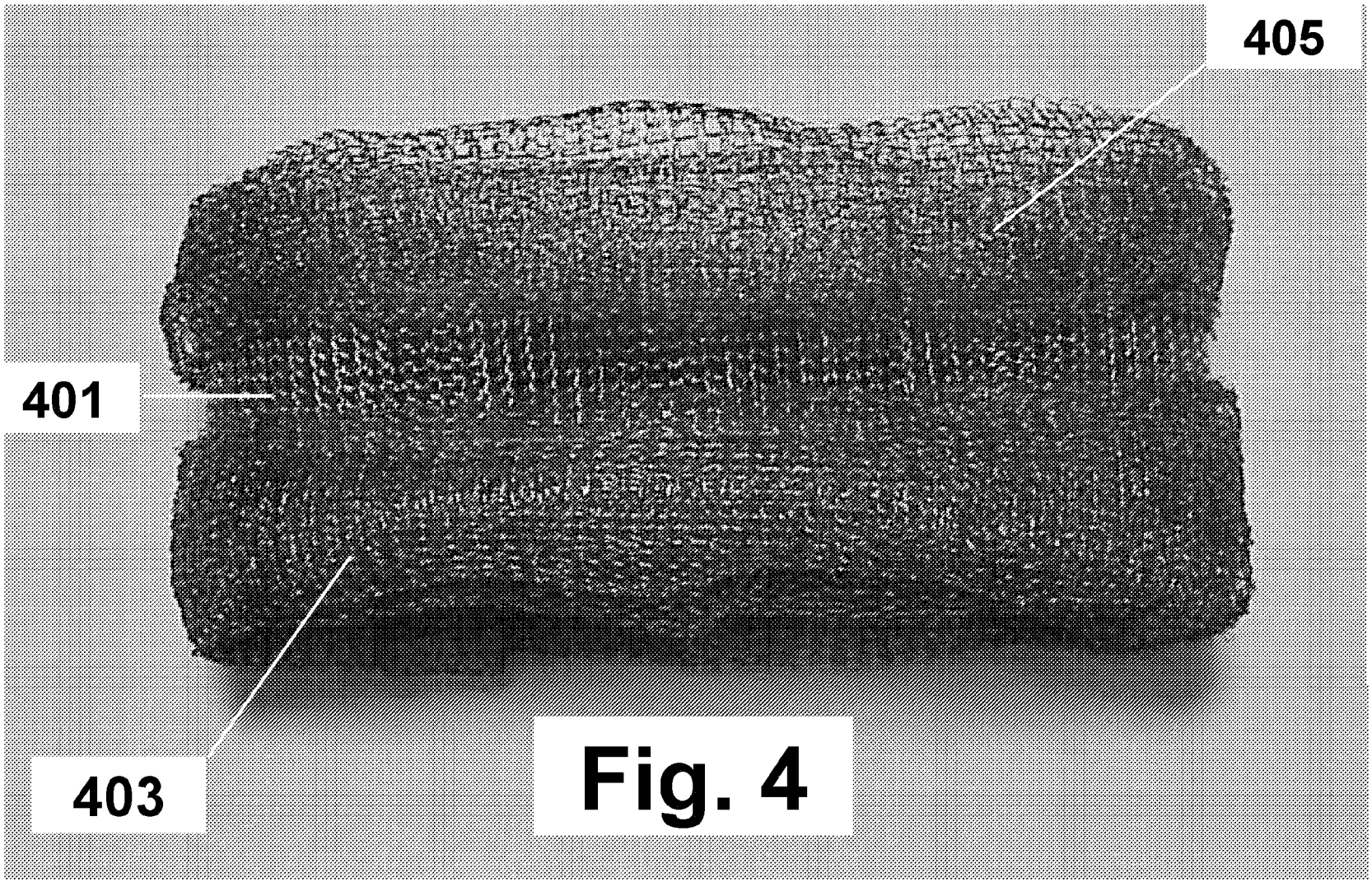
FIG. 4 depicts the interdisposed tubes as in FIG. 2 having been rolled up from both ends.
Figure 5:
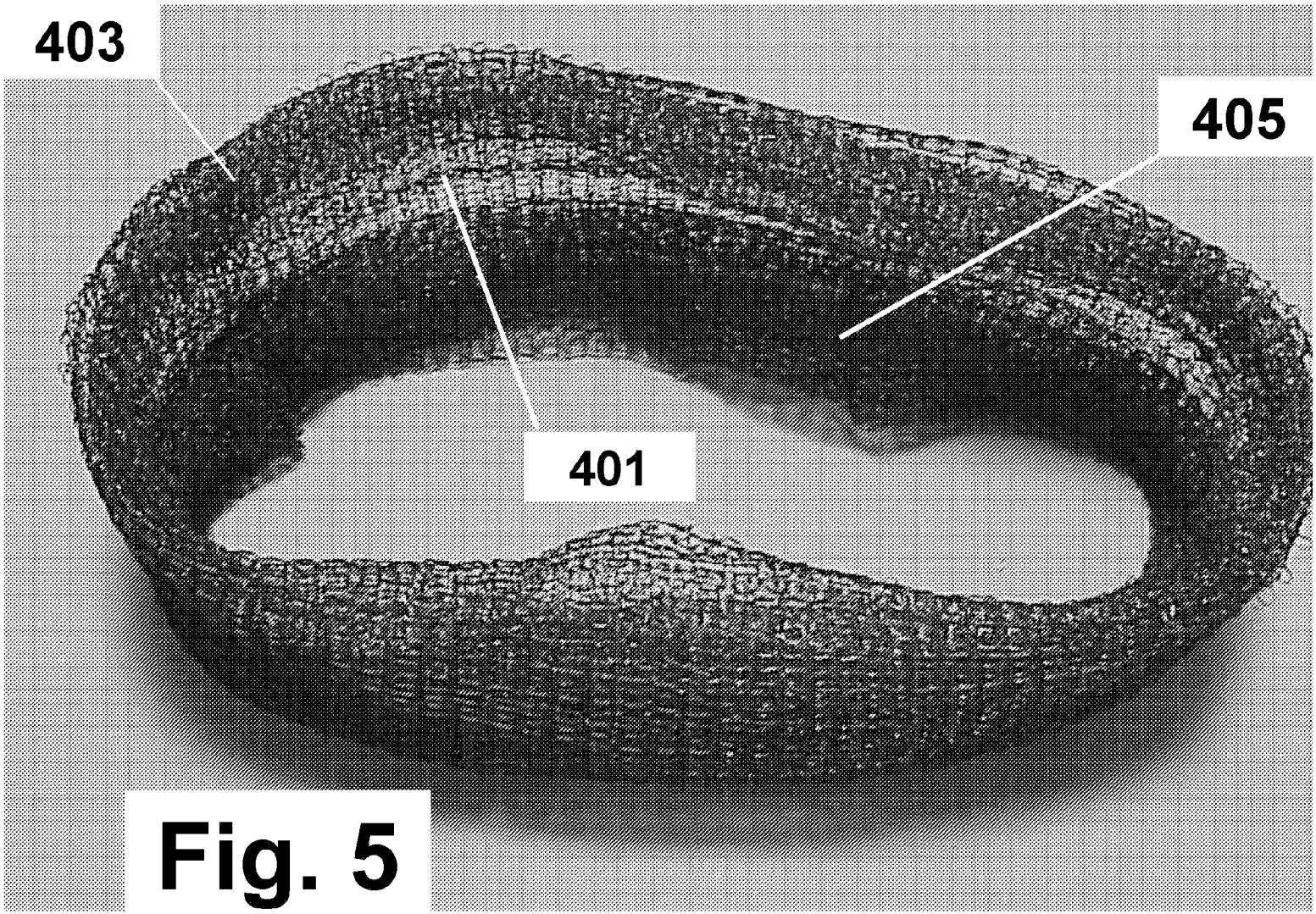
FIG. 5 depicts the rolled-up interdisposed tubes of FIG. 4 having been inverted (turned inside out).

In yet another embodiment, the element can be made so that different areas of the element have different densities, and so the axial and radial compression properties can be varied. The density of a fabric, or wire mesh, is determined by the number of courses per inch (cpi; the number of repeats of the knit pattern per unit length). The density of each of the outside (flat wire) or inside (round wire) meshes can be varied as desired. Because the internal (round) wire is harder, it has a larger effect on the compression characteristics of the element. The compression characteristics of the device can be tailored by varying the cpi of the flat wire to the cpi of the round wire. In addition, the axial and radial compression characteristics can be varied using two separate tori, one for the lip or flange portion and one for the body or ring portion of the element shown in FIG. 3. As shown in FIG. 4, the interdisposed tubes 401 can be rolled up from opposing ends, shown as separate rolls 403 and 405, to provide separate tori. The length (amount) of material provided for each torus will determine its compression characteristics, so the interdisposed tubes can be rolled up by different amounts, providing tori with different amounts of material; and as noted above, the cpi of each mesh can also be varied. Once rolled up as in FIG. 4, the intermediate article is inverted (turned inside out) as shown in FIG. 5, and then molded as described above, where one torus becomes the lip or flange portion and the other torus becomes the body or ring portion.

Other embodiments of the invention provide a single sock (knit tube) made from both the soft and hard wires, and round and flat (or half-flat) wires. Knitting machine heads typically have a number of feeds for the material (thread for making clothing, wire for the present invention), each being knitted into the tube. In an embodiment having two wires in a single tube, two different wires are fed alternating around the knitting head, or are fed alternating by twos (e.g., a soft round wire, a hard round wire, a soft flat wire, a hard flat wire, etc. repeating), or in any desired arrangement or combination, regular or irregular. The aforementioned A286 is precipitation-hardened via thermal treatment, whereas the aforementioned A300 wire is mechanically hardened. Accordingly, it is possible to make any desired combination of soft/hard and round/flat wires by varying the wires fed the knitting head, and thermal and/or mechanical treatment of the wire and/or an intermediate or final mesh.

Figure 6:
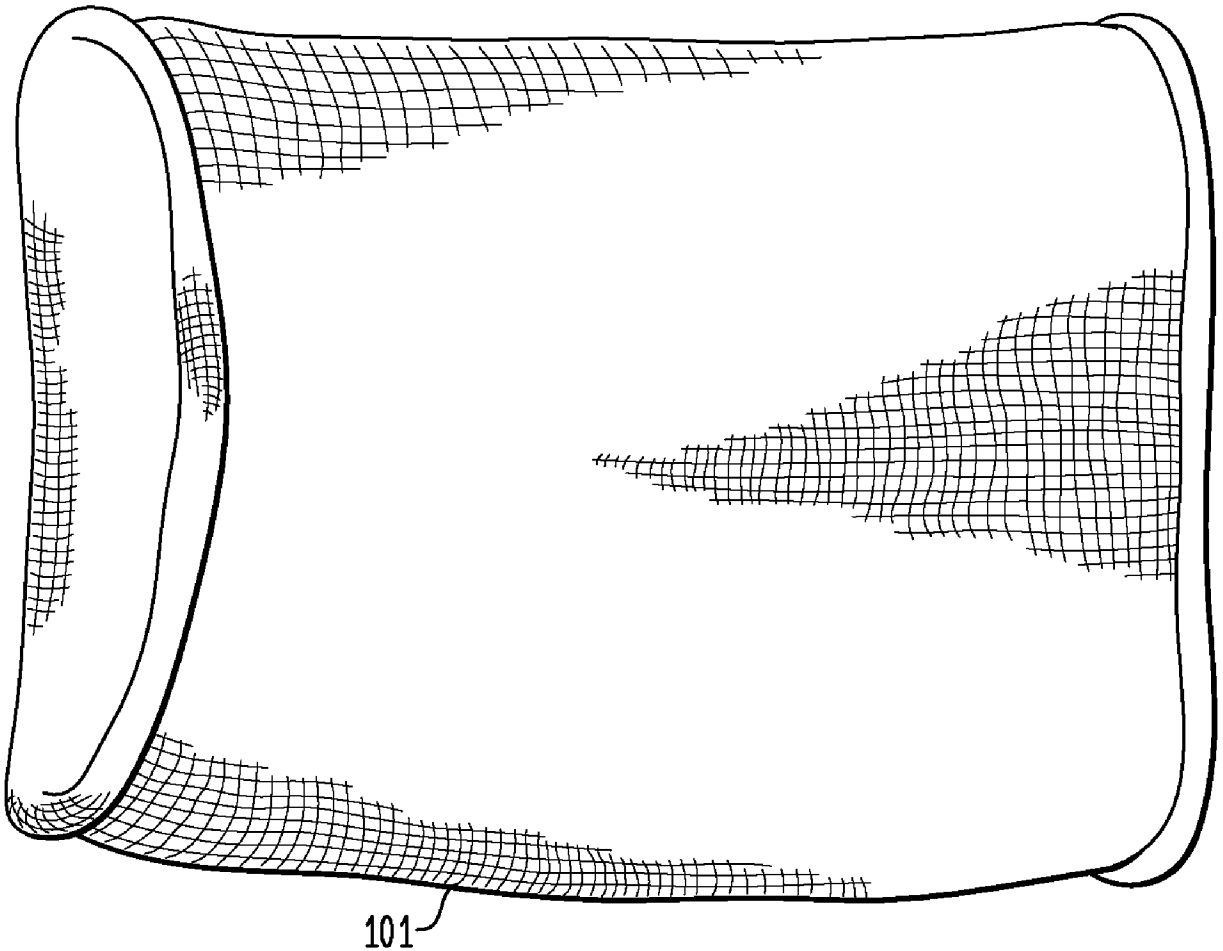
FIG. 6 depicts a single co-knit tube.

The number of round and flat wires need not be the same. In addition, a half-flat wire can be used. The flat wire provides better leak protection against gases bypassing the monolith. It is also possible to use hard flat and soft round wires, and combinations of various different types of wires. Thus, the compression characteristics of a seal made from a single tube can be tailored by varying the ratio of the number of hard round wires to the number of soft flat wires in the knitting head, as well as the number of soft wires and hard wires. A combination wire feed, where one wire is wrapped around another (for example, a flat wire wrapped around a round wire), can also be used. Any and all of the feeds can include the combination wire, or the combination wire can alternate with round and/or flat wires (e.g., combination, flat, round, half-flat, combination, flat, round, half-flat, etc.). As used herein, each of these embodiments wherein a single knitted tube has both hard round and soft flat wires knit together is termed "co-knit". It should also be appreciated that a co-knit tube as shown in FIG. 6 can be combined with a tube having a single wire, and that a co-knit tube can be one of the tubes in the above-described embodiment of over-knitting two tubes (i.e., one of the over-knitted tubes is co-knit with different wires), whereby two co-knit tubes can be overknit. Although the mesh knitted will vary depending on the compression and the final part desired, meshes for monoliths for catalytic converters are typically knitted with heads having 90 needles at 8 courses per inch, in a 12 inch width, with half the wires flat and half being round.

When the knitted mesh is compressed into a mold, the compression may not be even through the entire article. Accordingly, some of the aforementioned patents describe compressing the mesh into a mold, then removing the partially compressed mesh, flipping it around, and performing a second compression so that the density is fairly uniform through the article. Depending on the application, it may be desirable to use a mesh that has a density gradient, such as the partially compressed mesh before being flipped around. The difference in density is useful to create in a single article an area that is more dense, that can perform sealing functions, and an area that is less dense, to perform a mechanical bushing function. The choices of hard and soft wire, and where they are present within the article, will affect how the mesh compresses and the final density of the article.

The instant compressed mesh is also suitable as a support for catalyst systems, such as catalytic converters, including selective catalytic reduction (SCR) NOx systems, as well as for particular filters associated therewith, and seals for mounting the same (as in the above-described ceramic monolithic catalytic converter).

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A compressed knitted wire mesh seal element for an exhaust system, comprising a single knit tube being co-knit of a combination of an annealed soft wire and a flat, half-flat, or round wire, the co-knit tube being rolled into a ring and compressed into a geometry effective for sealing, wherein the flat, half-flat, or round wire is precipitation hardened to form a hard wire and wherein the geometry effective for sealing has a central bore and comprises a ring wall portion and a flange at one edge of the ring wall portion which extends into the central bore.

2. The element of claim 1, wherein the soft wire is fiat.

3. The element of claim 1, wherein the soft wire is at least as heat resistant as type 309 stainless steel.

4. The element of claim 1, wherein the soft wire has an oxide coating on its surface.

5. The element of claim 1, wherein the element has a rectilinear geometry, an elliptical geometry, or a combination thereof.

6. The element of claim 5, wherein the ring has multiple mesh layers.

7. The element of claim 1, wherein the hard and soft wires alternate with each other.

8. The element of claim 1, wherein the element has stripes of hard wire and stripes of soft wire.

9. The element of claim 1, wherein the element has stripes of round wire and stripes of flat wire.

10. The element of claim 1, wherein said co-knit tube is a first knit tube, and further comprising a second knit tube, the second knit tube and the first tube being overknit together prior to being rolled up and compressed.

11. The element of claim 10, wherein the second knit tube is co-knit.

12. The element of claim 10, wherein the first knit tube is crimped prior to compression.

13. The element of claim 10, wherein at least one of the first and second knit tubes is crimped prior to compression.

14. The element of claim 10, wherein the overknit mesh is crimped prior to compression.

15. The element of claim 10, wherein the first and second knit tubes are crimped prior to compression.

16. A catalytic converter assembly for an internal combustion engine exhaust, comprising: a monolithic substrate for a catalytic converter disposed in a housing and a knitted wire mesh seal element disposed on the upstream side of the converter; said knitted wire mesh seal element comprising a compressed co-knit tube having a combination of an annealed soft wire and a flat, half-flat, or round wire, the tube having been rolled into a ring and compressed into an annular geometry to produce said knitted wire mesh seal element, wherein the flat, half-flat, or round wire is precipitation hardened and wherein the annular geometry has a central bore and comprises a ring wall portion and a flange at one edge of the ring wall portion which extends into the central bore.

17. The assembly of claim 16, wherein the monolithic substrate is elliptical, rectilinear, or a combination thereof in cross-section, and the assembly further comprises a second co-knit wire mesh element disposed at the downstream end of the monolithic substrate.

18. A method of making a knitted wire mesh seal element for an exhaust system, comprising:

A. co-knitting an annealed soft wire and a flat, half-flat, or round wire into a co-knit tube;

B. rolling up a desired length of the co-knit tube; and

C. compressing the rolled-up co-knit tube in a mold of the desired shape to produce a knitted wire mesh seal element;

wherein the flat, half-flat, or round wire is precipitation hardened and wherein the element has a central bore and comprises a ring wall portion and a flange at one edge of the ring wall portion which extends into the central bore.

19. An article comprising at least one knitted wire mesh tube compressed into a geometry and having properties suitable for use as a seal, a bushing, or a support, said mesh comprising a combination of soft wires and flat, half-fiat, or round wires knitted together, at least some of said wires being fiat or having a fiat surface, the other wires being round or elliptical wires, wherein the flat, half-flat, or round wires are precipitation hardened and wherein the article has a central bore and comprises a ring wall portion and a flange at one edge of the ring wall portion which extends into the central bore.

20. The article of claim 19, wherein the knitted mesh is crimped prior to being compressed.

* * * * *